US011803142B1

(12) United States Patent
Shinohara

(10) Patent No.: US 11,803,142 B1
(45) Date of Patent: Oct. 31, 2023

(54) IMAGE FORMING APPARATUS AND CONTROL METHOD THEREOF

(71) Applicant: TOSHIBA TEC KABUSHIKI KAISHA, Tokyo (JP)

(72) Inventor: Eiji Shinohara, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/952,409

(22) Filed: Sep. 26, 2022

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
None
See application file for complete search history.

(56) References Cited

U.S. PATENT DOCUMENTS 6,248,978 B1 6/2001 Okuda
8,521,050 B2 8/2013 Kuribayashi
2003/0021618 A1* 1/2003 Ogara ..... G03G 21/0029 399/350
2007/0047991 A1* 3/2007 Itoh ..... G03G 15/2064 399/70
2012/0219308 A1* 8/2012 Fukaya ..... G03G 15/205 399/33
2017/0090371 A1* 3/2017 Sone ..... G03G 15/2042
2017/0192387 A1 7/2017 Tanaka
2021/0079829 A1* 3/2021 Raghunath ..... F01N 3/037
2022/0246996 A1* 8/2022 Peng ..... H01M 10/06

FOREIGN PATENT DOCUMENTS

CN 111755759 A * 10/2020
DE 102021003117 A1 * 12/2022

* cited by examiner

*Primary Examiner* — Sevan A Aydin
(74) *Attorney, Agent, or Firm* — AMIN, TUROCY & WATSON, LLP

(57) ABSTRACT

According to one embodiment, an image forming apparatus includes a forming unit, a heating unit, a temperature sensor, and a driving unit. The forming unit is configured to attach toner to a recording medium to form an image on the recording medium. The heating unit is configured to heat the toner that is attached to the recording medium by the forming unit to fix the image to the recording medium. The temperature sensor is configured to detect a temperature of the heating unit. The vibration unit is configured to apply vibration to the temperature sensor in a waiting period in which the image formation by the forming unit is not executed and the heating control by the heating unit is executed.

19 Claims, 3 Drawing Sheets

IMAGE FORMING APPARATUS AND CONTROL METHOD THEREOF

FIELD

Embodiments described herein relate generally to an image forming apparatus and a control method thereof.

BACKGROUND

An image forming apparatus using toner such as an electrophotographic method includes a fixing unit that heats, fuses, and fixes toner attached to a recording medium. The fixing unit generates heat at a high temperature. Therefore, the fixing unit includes a temperature sensor to control a heat generation temperature.

For example, in a waiting period in which actual image formation is not executed, the ON/OFF of a heater provided in the fixing unit is controlled such that a temperature detected by the temperature sensor approaches a predetermined controlled temperature. Therefore, the temperature sensor continuously applies a voltage in the waiting period.

Incidentally, it is known that, if a voltage is continuously applied to a printed circuit board or the like, ion migration occurs in the printed circuit board. If a crystal formed by the ion migration grows, short-circuiting may occur between wiring patterns.

The temperature sensor is in an environment where the ion migration is likely to occur, and countermeasures against the ion migration in the printed circuit board including the temperature sensor are desired.

DETAILED DESCRIPTION

In general, according to one embodiment, an image forming apparatus includes a forming unit, a heating unit, a temperature sensor, and a driving unit. The forming unit is configured to attach toner to a recording medium to form an image on the recording medium. The heating unit is configured to heat the toner that is attached to the recording medium by the forming unit to fix the image to the recording medium. The temperature sensor is configured to detect a temperature of the heating unit. The vibration unit is configured to apply vibration to the temperature sensor in a waiting period in which the image formation by the forming unit is not executed and the heating control by the heating unit is executed.

Hereinafter, an embodiment will be described using the drawings. In the following embodiment, a multi-function peripheral (MFP) including an image forming apparatus as a printer will be described as an example.

Figure 1:
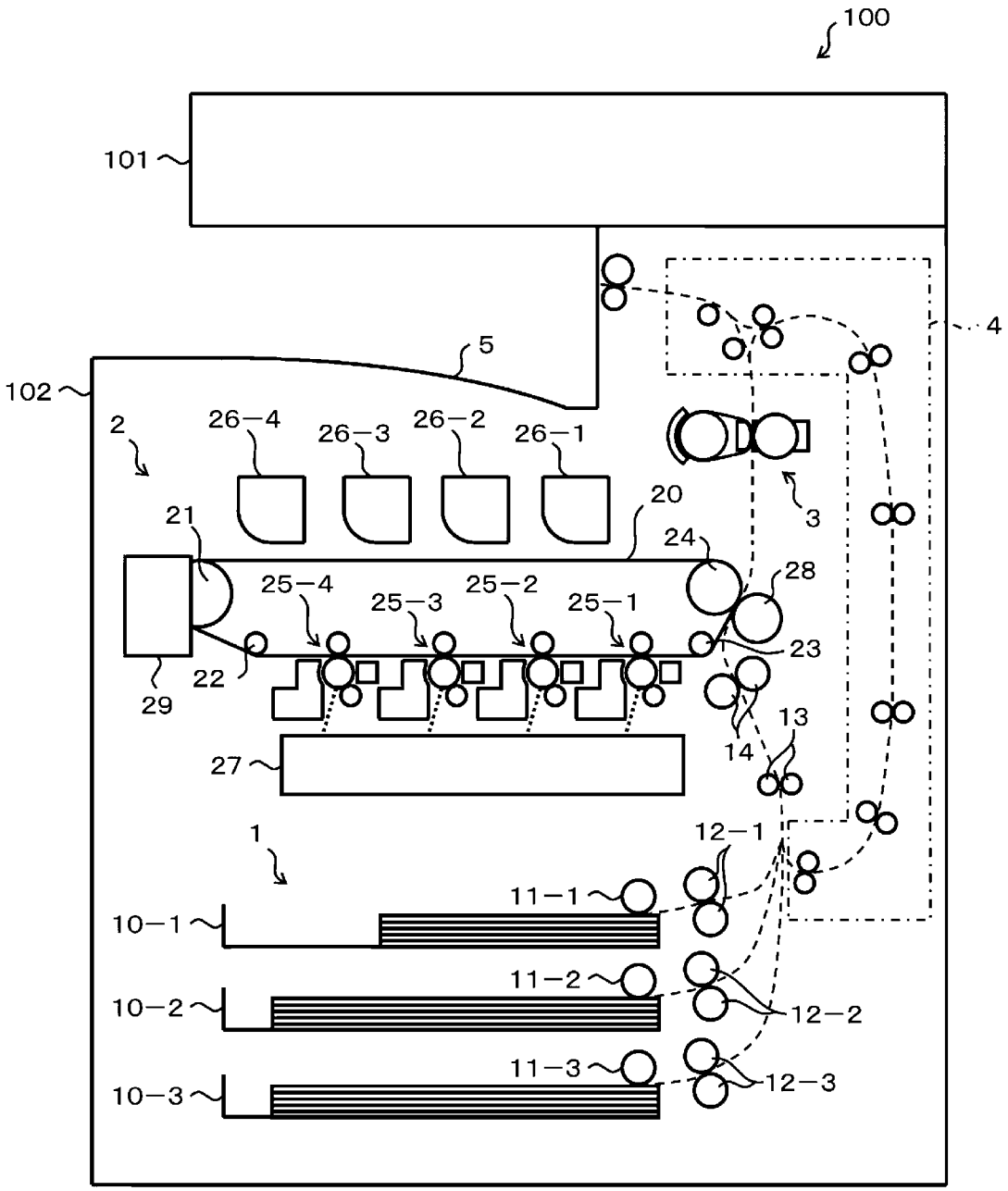
FIG. 1 is a diagram illustrating a mechanical configuration of an MFP according to one embodiment.

FIG. 1 is a diagram illustrating a mechanical configuration of an MFP 100 according to the embodiment. FIG. 1 does not exactly illustrate the mechanical configuration of the MFP 100, in which shapes and position relationships of some elements may also be different.

As illustrated in FIG. 1, the MFP 100 includes a scanner 101 and a printer 102.

The scanner 101 reads an image of a document and generates image data corresponding to the image. For example, the scanner 101 includes an image sensor such as a line sensor using a charge-coupled device (CCD). The scanner 101 generates image data corresponding to a reflected light image from a surface of a document that is read using the image sensor. The scanner 101 scans a document placed on a document tray using the image sensor that moves along the document. Alternatively, the scanner 101 scans a document that is conveyed by an auto document feeder (ADF) using a fixed image sensor.

The printer 102 forms an image using an electrophotographic method on a medium on which an image is to be formed. Typically, the medium is print paper such as cut paper. Therefore, in the following description, print paper is used as the medium. As the medium, a sheet of another paper different from cut paper may be used, or a sheet of a material such as a resin other than paper may be used. The printer 102 has a color printing function of printing a color image on print paper and a monochrome printing function of printing a monochrome image on print paper. The printer 102 forms a color image by forming element images to overlap each other with, for example, toners of three colors including yellow, magenta, and cyan or four colors including black in addition to the three colors. The printer 102 forms a monochrome image, for example, with black toner. The printer 102 may include only either one of the color printing function or the monochrome printing function.

In the configuration example illustrated in FIG. 1, the printer 102 includes a paper feed unit 1, a print engine 2, a fixing unit 3, an automatic duplexing unit (ADU) 4, and a paper discharge tray 5.

The paper feed unit 1 includes paper feed cassettes 10-1, 10-2, and 10-3, pickup rollers 11-1, 11-2, and 11-3, conveying rollers 12-1, 12-2, and 12-3, a conveying roller 13, and a registration roller 14.

The paper feed cassettes 10-1 to 10-3 accommodate sheets of print paper in a state where the sheets are stacked. The sheets of print paper accommodated in the paper feed cassettes 10-1 to 10-3 may be different types of print paper having different sizes and materials or may be the same type of print paper. In addition, the paper feed unit 1 may include a manual feed tray.

The pickup rollers 11-1 to 11-3 pick up the print paper one by one from each of the paper feed cassettes 10-1 to 10-3. The pickup rollers 11-1 to 11-3 supply the picked print paper to the conveying rollers 12-1 to 12-3.

The conveying rollers 12-1 to 12-3 supply the print paper supplied from the pickup rollers 11-1 to 11-3 to the conveying roller 13 through a conveyance path formed by a guide member (not illustrated) or the like.

The conveying roller 13 further conveys and supplies the print paper supplied from any one of the conveying rollers 12-1 to 12-3 to the registration roller 14.

The registration roller 14 corrects a tilt of the print paper. The registration roller 14 adjusts a timing at which the print paper is supplied to the print engine 2.

The paper feed cassettes, the pickup rollers, and the conveying rollers are not limited to three sets, and the number of sets may be freely set. If the manual feed tray is provided, it is not necessary to provide even one set including the paper feed cassette, the pickup roller, and the conveying roller, the paper feed cassette being paired with the pickup roller and the conveying roller.

The print engine 2 includes a belt 20, support rollers 21, 22, 23, and 24, image forming units 25-1, 25-2, 25-3, and 25-4, supply units 26-1, 26-2, 26-3, and 26-4, an exposure unit 27, a transfer roller 28, and a belt cleaner 29.

The belt 20 has an endless shape and is supported by the support rollers 21, 22, 23, and 24 to maintain the state illustrated in FIG. 1. The belt 20 rotates counterclockwise in FIG. 1 along with the rotation of the support roller 21. The belt 20 temporarily carries a toner image on a surface positioned on the outside (hereinafter, referred to as "image carrying surface"), the toner image being an image to be formed on the print paper. That is, the belt 20 is an example of the image carrier. From the viewpoints of heat resistance and wear resistance, for example, a semi-conductive polyimide is used as the belt 20. The image carrying surface moves along with the rotation of the belt 20 such that so-called sub-scanning is implemented, and a moving direction of the image carrying surface will also be referred to as "sub-scanning direction".

Each of the image forming units 25-1 to 25-4 includes a photoconductor, a charging unit, a developing unit, a transfer unit, and a cleaner. Each of the image forming units 25-1 to 25-4 forms an image using an electrophotographic method in cooperation with the exposure unit 27. The transfer unit may be provided in another unit such as a unit including the belt 20 instead of being provided in the image forming units 25-1 to 25-4, or may be present in a state where it does not belong to any of the units. The image forming units 25-1 to 25-4 are arranged along the belt 20 in a state where axis directions of the photoconductors thereof are parallel to each other. The image forming units 25-1 to 25-4 have the same structure and operation except that only the colors of the toners to be used are different from each other. The image forming unit 25-1 forms, for example, an element image of black. The image forming unit 25-2 forms, for example, an element image of cyan. The image forming unit 25-3 forms, for example, an element image of magenta. The image forming unit 25-4 forms, for example, an element image of yellow. The image forming units 25-1 to 25-4 form the respective color element images to overlap each other on the image carrying surface of the belt 20. As a result, the image forming units 25-1 to 25-4 form a color image in which the respective element images overlap each other on the image carrying surface of the belt 20 if the image carrying surface passes through the image forming unit 25-1.

The supply units 26-1, 26-2, 26-3, and 26-4 can mount toner bottles containing toners and can supply the toners contained in the mounted toner bottles to the image forming units 25-1 to 25-4, respectively. The toner bottle may contain the toner alone, that is may contain the toner as a so-called one-component developer, or may contain the toner as a so-called multi-component developer where the toner and another material such as a carrier are mixed. If the toner bottles contain the multi-component developers, the supply units 26-1, 26-2, 26-3, and 26-4 supply the toner together with the material such as a carrier. FIG. 1 does not illustrate paths through which the toners are supplied from the supply units 26-1 to 26-4 to the image forming units 25-1 to 25-4.

The exposure unit 27 exposes the photoconductor of each of the image forming units 25-1 to 25-4 in accordance with image data representing the respective color element images. As the exposure unit 27, for example, a laser scanner or a light emitting diode (LED) head is used. If the laser scanner is used, for example, the exposure unit 27 includes a semiconductor laser element, a polygon mirror, an imaging lens system, and a mirror. In this case, the exposure unit 27 selectively causes, for example, a laser beam emitted from the semiconductor laser element in accordance with image data to be incident on the respective photoconductors of the image forming units 25-1 to 25-4 by changing an emission direction from the mirror. The exposure unit 27 deflects the laser beam in the axis direction of the photoreceptor (a depth direction in FIG. 1) with the polygon mirror for scanning the photoconductor. This scanning with the laser beam is a so-called main scanning, and the direction thereof will be referred to as "main scanning direction".

The transfer roller 28 is arranged parallel to the support roller 24, and the belt 20 is interposed between the transfer roller 28 and the support roller 24. The print paper supplied from the registration roller 14 is interposed between the transfer roller 28 and the image carrying surface of the belt 20. The transfer roller 28 transfers the toner image formed on the image carrying surface of the belt 20 to the print paper using an electrostatic force.

The belt cleaner 29 removes toner remaining on the image carrying surface of the belt 20 without being completely transferred to the print paper.

Thus, the print engine 2 forms the image using an electrophotographic method on the print paper supplied by the registration roller 14. That is, the print engine 2 is an example of the forming unit configured to attach the toner to the print paper as a medium to form an image on the print paper.

The fixing unit 3 melts the toner that is attached to the print paper supplied from the print engine 2 such that the toner is fixed to the print paper. The configuration of the fixing unit 3 will be described below.

The ADU 4 includes a plurality of rollers and selectively executes the following two operations. In the first operation, the print paper that passes the fixing unit 3 is supplied to the paper discharge tray 5 as it is. The first operation is executed after completion of one-sided printing or double-sided printing. In the second operation, the print paper that passes the fixing unit 3 is temporarily conveyed to the paper discharge tray 5 side, is switched back, and then is supplied to the print engine 2. The second operation is executed after completion of image formation on only one side during double-sided printing.

The paper discharge tray 5 receives the discharged print paper on which the image is formed.

Figure 2:
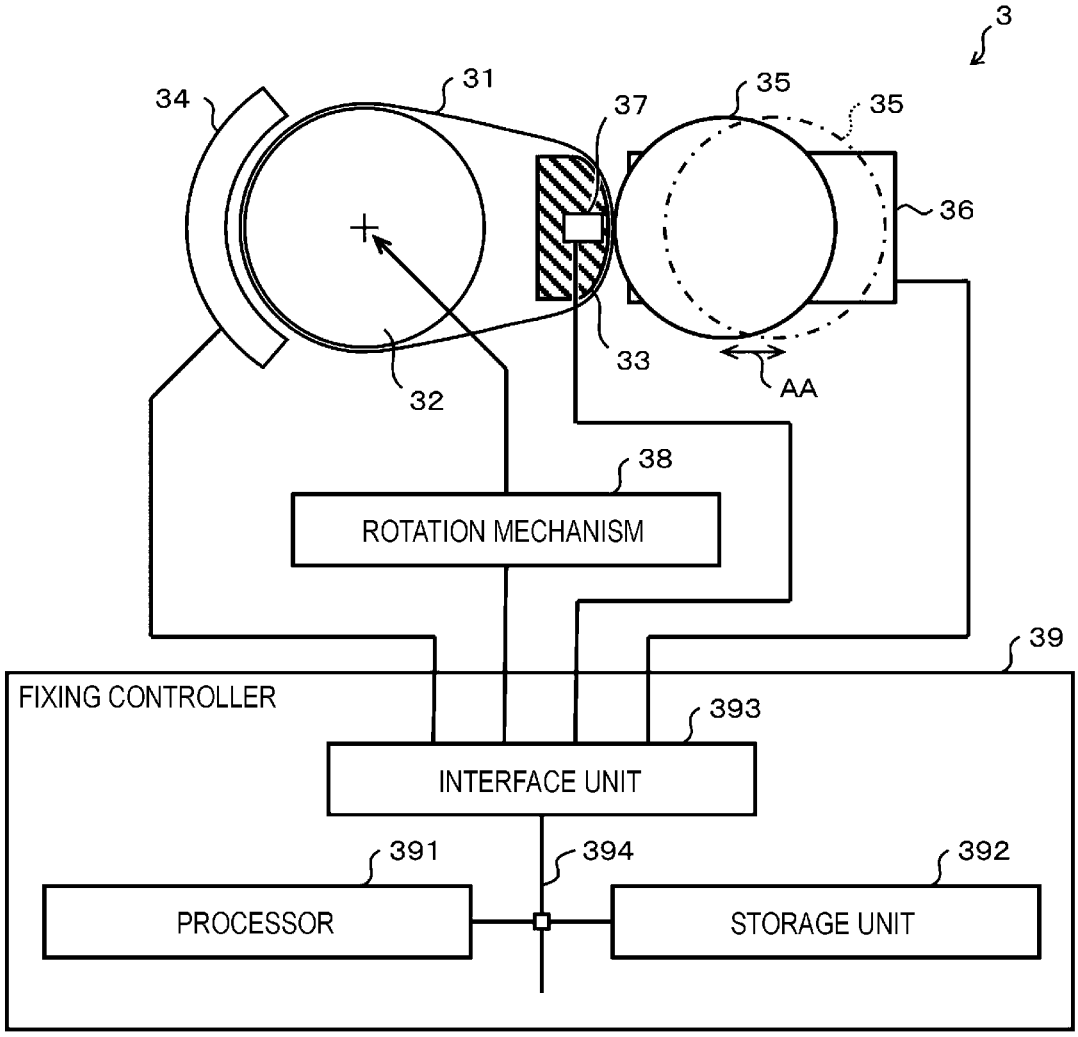
FIG. 2 is a mechanism map and a block diagram illustrating a configuration of a fixing unit illustrated in FIG. 1.

FIG. 2 is a mechanism map and a block diagram illustrating a configuration of the fixing unit 3.

The mechanism map in FIG. 2 is schematically illustrated, and the relative sizes and positions of the respective elements are not always exactly illustrated.

The fixing unit 3 includes a fixing belt 31, a support roller 32, a pressing pad 33, a heater 34, a pressing roller 35, a moving mechanism 36, a temperature sensor 37, a rotation mechanism 38, and a fixing controller 39. A cross-section of the pressing pad 33 is illustrated.

The fixing belt 31 is, for example, an endless belt formed of a heat-resistant resin. The fixing belt 31 is supported by the support roller 32 to rotate around a rotation axis extending in a depth direction in FIG. 2. A length (hereinafter, referred to as "belt width") of the fixing belt 31 in the rotation axis direction is more than a maximum value of a length (hereinafter, referred to as "medium width") of the print paper in a direction (the depth direction in FIG. 2) perpendicular to a conveying direction (an up-down direction in FIG. 2) of the print paper. The fixing belt 31 heats the print paper and the developer attached to the print paper using the heater 34.

The support roller 32 is a cylindrical tubing material and supports the fixing belt 31 on a side surface as described above. The length of the support roller 32 in the axis direction is more than the belt width in the embodiment. The length of the support roller 32 in the axis direction is the same as the belt width or may be slightly less than the belt width.

The pressing pad 33 is provided in contact with an inner side surface of the fixing belt 31 and presses the fixing belt 31 against the pressing roller 35.

The heater 34 heats the fixing belt 31. The heater 34 is, for example, an induction heater (IH) that heats the fixing belt 31 by electromagnetic induction, and any other type of heater can be appropriately used. If the IH heater is used as the heater 34, as the fixing belt 31, for example, a belt that is treated to form a metal film on the surface such that an induced current can be generated is used.

The pressing roller 35 is provided parallel to the fixing belt 31. The pressing roller 35 is axially supported by a support mechanism (not illustrated) to rotate around the rotation axis extending in the depth direction in FIG. 2. The length of the pressing roller 35 in the rotation axis direction is more than the maximum width of the print paper in the embodiment. Here, the length of the pressing roller 35 in the rotation axis direction is the same as the maximum width of the print paper or may be slightly less than the maximum width of the print paper. The pressing roller 35 conveys the print paper conveyed from print engine 2 to the paper discharge tray 5 side in a state where the print paper is interposed between the pressing roller 35 and the fixing belt 31. The pressing roller 35 presses the print paper if the print paper is interposed between the pressing roller 35 and the pressing pad 33 together with the fixing belt 31.

Thus, the heater 34 is an example of the heat generation member. The fixing belt 31 is an example of the heat transfer member. The pressing pad 33 and the pressing roller 35 are an example of the pressing member. By using the fixing belt 31, the pressing pad 33, the heater 34, and the pressing roller 35 or further using the moving mechanism 36, the heating unit that heats the toner on the print paper as the recording medium to fix the image to the recording medium is implemented.

The moving mechanism 36 includes a power source and a gear and reciprocates the pressing roller 35 in a direction indicated by an arrow AA in FIG. 2. That is, the moving mechanism 36 moves the pressing roller 35 between a position indicated by a solid line in FIG. 2 and a position indicated by a chain line in FIG. 2. If the pressing roller 35 is present at the position indicated by the solid line in FIG. 2, the pressing roller 35 presses the print paper against the fixing belt 31 as described above. If the pressing roller 35 is preset at the position indicated by the chain line in FIG. 2, the pressing roller 35 is separated from the fixing belt 31.

The temperature sensor 37 measures a temperature of the fixing belt 31 and outputs a detection value corresponding to the temperature. Typically, the temperature sensor 37 is disposed to measure a temperature in the vicinity of the center of the fixing belt 31 in a longitudinal direction. Here, the temperature sensor 37 may be provided at any position as long as it can measure the temperature of the fixing belt 31. In the example of FIG. 2, the temperature sensor 37 is provided to measure the temperature of the fixing belt 31 at a position in contact with the print paper in a state where it is inserted into the pressing pad 33. Here, the temperature sensor 37 may be provided to measure the temperature of the fixing belt 31 at any position different from the above-described position. In addition, the temperature sensor 37 is provided to face a surface opposite to a surface in contact with the print paper among two surfaces of the fixing belt 31, but may be provided to face the other surface of the fixing belt 31. The temperature sensor 37 may be provided to measure a temperature of the heater 34, a temperature of the pressing roller 35, or a surrounding atmosphere temperature of the fixing belt or the pressing roller 35. That is, the temperature sensor 37 may be provided to measure the temperature of the fixing belt 31 not only directly but also indirectly.

The rotation mechanism 38 includes a power source and a gear and rotates the support roller 32.

The fixing controller 39 controls an operation of the fixing unit 3. The fixing controller 39 includes a processor 391, a storage unit 392, an interface unit 393, and a transmission line 394. The processor 391, the storage unit 392, and the interface unit 393 are connected via the transmission line 394.

By connecting the processor 391 and the storage unit 392 via the transmission line 394, a computer that executes information processing for controlling the operation of the fixing unit 3 is configured.

The processor 391 corresponds to a central part of the computer. The processor 391 executes information processing described below in accordance with an information processing program such as an operating system, middleware, or an application program.

The storage unit 392 corresponds to a main memory part and an auxiliary storage part of the computer. The storage unit 392 includes a memory region for read only and a rewritable memory region. The storage unit 392 stores the above-described information processing program in one of at least the memory region for read only and the rewritable memory region. The storage unit 392 may also store data required to execute a process for allowing the processor 391 to control the respective units in one of at least the memory region for read only and the rewritable memory region. The storage unit 392 uses the rewritable memory region as a work area for the processor 391.

The interface unit 393 outputs control signals for controlling the heater 34, the moving mechanism 36, and the rotation mechanism 38 to the respective units in accordance with instructions of the processor 391. The interface unit 393 takes in the detection value output from the temperature sensor 37 and notifies the detection value to the processor 391.

The transmission line 394 includes an address bus, a data bus, and a control signal line or the like. The transmission line 394 transmits data and a signal that are received from and transmitted to each of the units connected thereto.

Next, an operation of the MFP 100 configured as described above will be described. A characteristic of the operation of the MFP 100 is the operation of the fixing unit 3 in a waiting state where the printer 102 does not print an image. Therefore, the characteristic operation will be described. The other operations of the MFP 100 may be the same as those of the same type of an existing MFP, and the description thereof will not be repeated.

If the printer 102 is in the waiting state, the processor 391 in the fixing unit 3 executes a waiting control in accordance with the information processing program stored in the storage unit 392.

Figure 3:
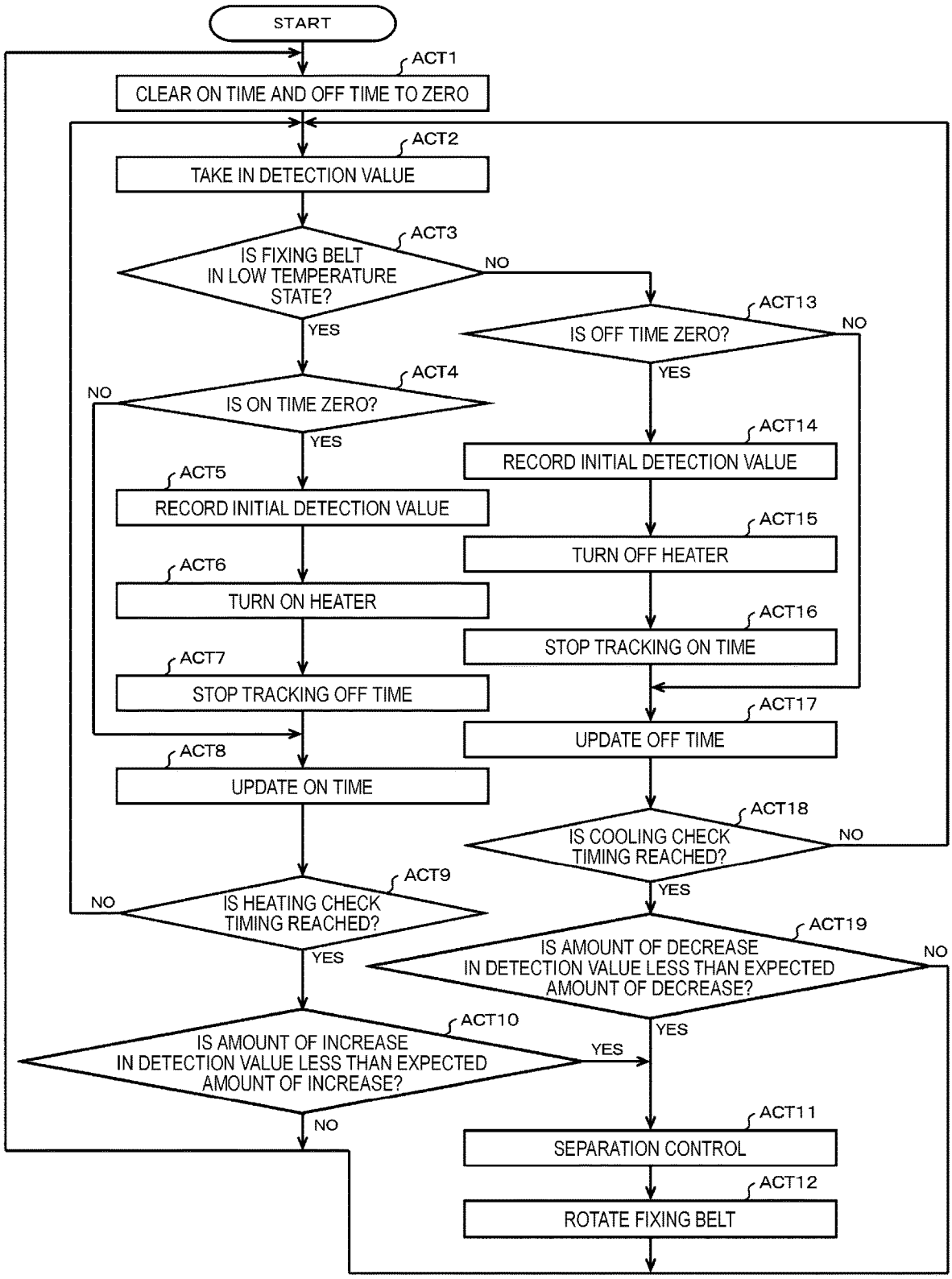
FIG. 3 is a flowchart illustrating information processing in a waiting control.

FIG. 3 is a flowchart of the information processing by the processor 391 in the waiting control.

In ACT 1, the processor 391 clears an ON time and an OFF time to zero. The ON time is a value obtained by tracking the duration time in a state where the heater 34 is turned on. The OFF time is a value obtained by tracking the duration time in a state where the heater 34 is turned off. The processor 391 substitutes zero into a variable OnCntr determined for the ON time. In addition, the processor 391 substitutes zero into a variable OffCntr determined for the OFF time.

In ACT 2, the processor 391 takes in the detection value of the temperature sensor 37. For example, the processor 391 inputs the detection value output from the temperature sensor 37 via the interface unit 393, and substitutes the detection value into a variable TmpCu determined for the latest detection value.

In ACT 3, the processor 391 checks whether or not the fixing belt 31 is in a low temperature state. The low temperature state is a state where the fixing belt 31 needs to be heated. For example, if the value of the variable TmpCu is less than a predetermined target value, the processor 391 determines YES as the fixing belt 31 is in the low temperature state, and proceeds to ACT 4. If the temperature of the fixing belt 31 is a predetermined temperature as the controlled temperature in the waiting state, the target value may be appropriately determined by, for example, a designer of the MFP 100 in consideration of the detection value that is normally output from the temperature sensor 37. A condition for determining that the fixing belt 31 is in the low temperature state may be appropriately determined by, for example, the designer of the MFP 100. For example, a state where the value of the variable TmpCu is less than or equal to the predetermined target value may be determined as the low temperature state. In addition, for example, a state where the value of the variable TmpCu is less than a heating start value determined as a value less than the target value may be determined as the low temperature state.

In ACT 4, the processor 391 checks whether or not the ON time is zero. For example, if OnCntr=0 is satisfied, the processor 391 determines YES and proceeds to ACT 5.

In ACT 5, the processor 391 records an initial detection value. The initial detection value is a detection value of the temperature sensor 37 at a timing at which the heater is turned on. For example, the processor 391 substitutes the value of the variable TmpCu into a variable Tmpin determined for the initial detection value.

In ACT 6, the processor 391 turns on the heater 34. As a result, the heating of the fixing belt 31 is started.

In ACT 7, the processor 391 stops tracking the OFF time if the heater 34 is turned on as described above. For example, the processor 391 substitutes zero into the variable OffCntr. Next, the processor 391 proceeds to ACT 8. When the ON time, that is, the value of the variable OnCntr is not zero, the processor 391 determines NO in ACT 4, skips ACT 5 to ACT 7, and proceeds to ACT 8.

In ACT 8, the processor 391 updates the ON time. For example, the processor 391 increases the value of the variable OnCntr by a predetermined number. Here, the increase number is, for example, "1" and may be appropriately determined by the designer of the MFP 100 or the like. That is, the processor 391 updates the value of the variable OnCntr to the value obtained as, for example, [OnCntr+1].

In ACT 9, the processor 391 checks whether or not a heating status check timing is reached. For example, when the ON time reaches a predetermined heating time, the processor 391 determines that the heating status check timing is reached. That is, if a predetermined value corresponding to the heating time is represented by TimHe, and as long as [OnCntr>TimHe] is satisfied, the processor 391 determines that the heating status check timing is reached. If the processor 391 cannot determine that the heating status check timing is reached, the processor 391 determines NO in ACT 9 and returns to ACT 2. At this time, as long as the low temperature state is maintained, the processor 391 repeats ACT 4, ACT 8, and ACT 9. That is, the processor 391 waits until the heating status check timing is reached while periodically repeatedly achieving the latest detection value by the temperature sensor 37.

If the processor 391 proceeds to ACT 9 in a state where [OnCntr>TimHe] is satisfied, the processor 391 determines YES as the heating status check timing is reached, and proceeds to ACT 10.

In ACT 10, the processor 391 checks whether or not an amount of increase in the detection value of the temperature sensor 37 from the ON of the heater 34 to the check timing is less than a normally expected amount of temperature increase by comparing the amounts of increase. For example, if a threshold determined as the amount of change in the detection value of the temperature sensor 37 caused by a temperature change that is less than the normally expected amount of temperature increase is represented by ThIn, as long as [TmpCu−Tmpin<ThIn)] is not satisfied, the processor 391 determines NO as the amount of increase in the detection value is not less than the normally expected amount of temperature increase, and repeats the processes after ACT 1 as described above.

The threshold ThIn may be appropriately determined, for example, by a designer of the MFP 100. Here, the threshold ThIn should be appropriately determined in consideration of the heating performance of the fixing belt 31 by the heater 34. A condition for determining that the amount of increase in the detection value is less than the normally expected amount of temperature increase may be determined by, for example, the designer of the MFP 100. For example, a state where [TmpCu−Tmpin≤ThIn] is satisfied may be determined as the state where the amount of increase in the detection value is less than the normally expected amount of temperature increase.

For example, if [TmpCu−Tmpin<ThIn] is satisfied, the processor 391 determines YES as the amount of increase in the detection value is less than the normally expected amount of temperature increase in ACT 10 and proceeds to ACT 11. At this time, the processor 391 determines that the detection state of the temperature sensor 37 is an abnormal state.

In ACT 11, the processor 391 executes a separation control. The separation control is a control of the moving mechanism 36 for forming a state where the pressing roller 35 is separated from the fixing belt 31. The processor 391 operates the moving mechanism 36 to change, for example, from a state where the pressing roller 35 abuts against the fixing belt 31 to a state where the pressing roller 35 is separated from the fixing belt 31 as indicated by a chain line in FIG. 1.

In ACT 12, the processor 391 rotates the fixing belt 31 for a predetermined period of time. That is, the processor 391 starts the rotation mechanism 38 to rotate the support roller 32. If the fixing belt 31 rotates together with the rotation of the support roller 32, the temperature sensor 37 vibrates. If a crystal formed by ion migration is attached to a printed circuit board provided in the temperature sensor 37, this crystal is broken by vibration, and the subsequent growth of the crystal is inhibited. Next, if a predetermined period of time is elapsed, the processor 391 stops the rotation mechanism 38. Here, the period of time for which the fixing belt 31 rotates is longer than a period of time required to break the crystal formed on the printed circuit board and may be appropriately determined, for example, by a designer of the MFP 100. If the rotation of the fixing belt 31 ends, the processor 391 repeats the processes after ACT 1.

If the fixing belt 31 is not in the low temperature state, the processor 391 determines No in ACT 3 and proceeds to ACT 13. That is, for example, if the value of the variable TmpCu is more than or equal to the predetermined target value, the processor 391 determines NO as the fixing belt 31 is not in the low temperature state and proceeds to ACT 13. A condition for determining that the fixing belt 31 is not in the low temperature state may be determined by, for example, the designer of the MFP 100. For example, a state where the value of the variable TmpCu is more than the predetermined target value may be appropriately determined not as a state of the low temperature state. In addition, for example, a state where the value of the variable TmpCu is more than or equal to a cooling start value determined as a value more than the target value may be determined not as a state of low temperature state.

In ACT 13, the processor 391 checks whether or not the OFF time is zero. For example, if [OffCntr=0] is satisfied, the processor 391 determines YES and proceeds to ACT 14.

In ACT 14, the processor 391 records an initial detection value in the manner similar to that as in ACT 5.

In ACT 15, the processor 391 turns off the heater 34. As a result, the fixing belt 31 is in a state where it is naturally cooled.

This way, the processor 391 controls the ON/OFF of the heater 34 such that the detection value of the temperature sensor 37 approaches the target value. That is, the processor 391 functions as the control unit configured to control heat generation of the heater 34 as the heat generation member such that the temperature detected by the temperature sensor 37 approaches the controlled temperature.

In ACT 16, the processor 391 stops tracking the ON time if the heater 34 is turned off as described above. For example, the processor 391 substitutes zero into the variable OnCntr. Next, the processor 391 proceeds to ACT 17. When the OFF time, that is, the value of the variable OffCntr is not zero, the processor 391 determines NO in ACT 13, skips ACT 14 to ACT 16, and proceeds to ACT 17.

In ACT 17, the processor 391 updates the OFF time. For example, the processor 391 increases the value of the variable OffCntr by a predetermined number. Here, the increase number is, for example, "1" and may be appropriately determined by the designer of the MFP 100 or the like. That is, the processor 391 updates the value of the variable OffCntr to the value obtained as, for example, [OffCntr+1].

In ACT 18, the processor 391 checks whether or not a cooling status check timing is reached. For example, when the OFF time reaches a predetermined cooling time, the processor 391 determines that the cooling status check timing is reached. That is, if a predetermined value corresponding to the cooling time is represented by TimCo, as long as [OnCntr>TimCo] is satisfied, the processor 391 determines that the cooling status check timing is reached. If the processor 391 cannot determine that the cooling status check timing is reached, the processor 391 determines NO in ACT 18 and returns to ACT 2. At this time, as long as the state not being the low temperature state is maintained, the processor 391 repeats ACT 13, ACT 17, and ACT 18. That is, the processor 391 waits until the cooling status check timing is reached while periodically repeatedly achieving the latest detection value by the temperature sensor 37.

If the processor 391 proceeds to ACT 18 in a state where [OffCntr>TimCo] is satisfied, the processor 391 determines YES and that the cooling status check timing is reached, and proceeds to ACT 19.

In ACT 19, the processor 391 checks whether or not an amount of decrease in the detection value of the temperature sensor 37 from the OFF of the heater 34 to the check timing is less than a normally expected amount of temperature decrease by comparing the amounts of decrease. For example, if a threshold determined as the amount of change in the detection value of the temperature sensor 37 caused by a temperature change that is less than the normally expected amount of temperature decrease is represented by ThFa, as long as [TmpCu−Tmpin<ThFa)] is not satisfied, the processor 391 determines NO as the amount of decrease in the detection value is not less than the normally expected amount of temperature decrease, and repeats the processes after ACT 1 as described above.

The threshold ThFa may be appropriately determined, for example, by a designer of the MFP 100. Here, the threshold ThFa should be determined in consideration of characteristics relating to the natural cooling of the fixing belt 31. A condition for determining that the amount of decrease in the detection value is less than the normally expected amount of temperature decrease may be appropriately determined by, for example, the designer of the MFP 100. For example, a state where [TmpCu−Tmpin≤ThFa] is satisfied may be determined as the state where the amount of decrease in the detection value is less than the normally expected amount of temperature decrease.

For example, if [TmpCu−Tmpin<ThFa] is satisfied, the processor 391 determines YES as the amount of decrease in the detection value is less than the normally expected amount of temperature decrease in ACT 19 and proceeds to ACT 11. The processor 391 executes the processes after ACT 11 as described above. At this time, the processor 391 determines that the detection state of the temperature sensor 37 is an abnormal state.

As described above, in the MFP 100, in the waiting state where the temperature of the fixing belt 31 is controlled to approach the controlled temperature, by vibrating the temperature sensor 37, the growth of the crystal formed by ion migration is inhibited. As a result, in the MFP 100, the occurrence of failure in the temperature sensor 37 caused by the crystal formed by ion migration can be prevented.

In the MFP 100, by rotating the fixing belt 31, vibration is applied to the temperature sensor 37. Therefore, it is not necessary to provide a device for generating vibration.

In the MFP 100, a timing at which the temperature sensor 37 is vibrated is set as a timing at which the amount of increase in the detection value of the temperature sensor 37 if the fixing belt 31 is heated for the predetermined heating time is small. In addition, in the MFP 100, a timing at which the temperature sensor 37 is vibrated is set as a timing at which the amount of increase in the detection value of the temperature sensor 37 if the fixing belt 31 is cooled for the predetermined cooling time is small. If the crystal formed by ion migration is attached to the printed circuit board of the temperature sensor 37, the detection value of the temperature sensor 37 may be fixed to a given value irrespective of the temperature of the fixing belt 31. Therefore, in the MFP 100, if this status is suspected, the removal of the crystal formed by ion migration can be attempted.

This embodiment can be modified as follows in various ways.

Vibration may be applied to the temperature sensor 37 intermittently at given time intervals or continuously.

A general roller may be used instead of the fixing belt 31 and the pressing pad 33.

The same structure as the fixing belt 31 and the pressing pad 33 may be provided instead of the pressing roller 35. A non-rotating member such as a fixed plate member may be used instead of the pressing roller 35.

The moving mechanism 36 may move the fixing belt 31 instead of moving the pressing roller 35. Alternatively, the moving mechanism 36 may move both of the fixing belt 31 and the pressing roller 35.

A vibrator or the like that generates vibration to apply the vibration to the temperature sensor 37 may be additionally provided.

A part or all of the respective functions that are implemented by the processor 391 through the information processing can also be implemented by hardware that executes information processing not based on a program, for example, a logic circuit. In addition, each of the respective functions can also be implemented by a combination of the hardware such as a logic circuit and a software control.

While certain embodiments have been described, these embodiments have been presented by way of example only, and are not intended to limit the scope of the inventions. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a forming component configured to attach toner to a recording medium to form an image on the recording medium;

a heating component configured to heat the toner that is attached to the recording medium by the forming component in order to fix the image to the recording medium;

a temperature sensor configured to detect a temperature of the heating component; and a vibration component configured to apply vibration to the temperature sensor in a waiting period in which image formation by the forming component is not executed and heating control by the heating component is executed.

2. The image forming apparatus according to claim 1, wherein the heating component further comprises a heat generation member configured to generate heat, a heat transfer member configured to transfer the heat generated by the heat generation member to the recording medium while rotating, a pressing member configured to press the recording medium against the heat transfer member, and a moving mechanism configured to move one of at least the heat transfer member and the pressing member such that the heat transfer member and the pressing member approach or are separated from each other, and the vibration component rotates the heat transfer member while causing the moving mechanism to make the heat transfer member and the pressing member approach each other.

3. The image forming apparatus according to claim 1, wherein the heating component further comprises a heat generation member configured to generate heat, and a controller configured to control the heat generation of the heat generation member such that a temperature detected by the temperature sensor approaches a controlled temperature in the waiting period, and the vibration component applies vibration to the temperature sensor if a detection state of the temperature sensor during execution of the control of the heat generation of the heat generation member by the controller is a predetermined abnormal state.

4. The image forming apparatus according to claim 3, wherein the vibration component recognizes, as the abnormal state, a state where a change in the temperature detected by the temperature sensor in a state where the heat generation member generates heat is less than a predetermined change.

5. The image forming apparatus according to claim 3, wherein the vibration component recognizes, as the abnormal state, a state where a change in the temperature detected by the temperature sensor in a state where the heat generation member does not generate heat is less than a predetermined change.

6. The image forming apparatus according to claim 1, wherein the heating component is an induction heater.

7. The image forming apparatus according to claim 1, wherein the image forming apparatus is a color image forming apparatus.

8. A control method of an image forming apparatus including a forming component configured to attach toner to a recording medium to form an image on the recording medium, a heating component configured to heat the toner that is attached to the recording medium by the forming component in order to fix the image to the recording medium, and a temperature sensor configured to detect a temperature of the heating component, the control method comprising:

applying vibration to the temperature sensor in a waiting period in which image formation by the forming component is not executed and heating control by the heating component is executed.

9. The control method according to claim 8, wherein generating heat by a heat generation member, transferring, by a heat transfer member, the heat generated by the heat generation member to the recording medium while rotating, pressing the recording medium against the heat transfer member by a pressing member, and moving, by a moving mechanism, one of at least the heat transfer member and the pressing member such that the heat transfer member and the pressing member approach or are separated from each other, in the applying the vibration, rotating the heat transfer member while causing the moving mechanism to make the heat transfer member and the pressing member approach each other.

10. The control method according to claim 8, further comprising:

controlling the heat generation of the heat generation member that is provided in the heating unit and generates heat such that a temperature detected by the temperature sensor approaches a controlled temperature in the waiting period, wherein in the applying the vibration, applying vibration to the temperature sensor if a detection state of the temperature sensor during execution of the control of the heat generation of the heat generation member by the controller is a predetermined abnormal state.

11. The control method according to claim 10, wherein in the applying the vibration, as the abnormal state, detecting a state where a change in the temperature by the temperature sensor in a state where the heat generation member generates heat is less than a predetermined change is recognized.

12. The control method according to claim 10, wherein in the applying the vibration, as the abnormal state, detecting a state where a change in the temperature by the temperature sensor in a state where the heat generation member does not generate heat is less than a predetermined change is recognized.

13. The control method according to claim 8, further comprising:

using an induction heater to heat the toner.

14. A heat control system for an image forming apparatus, comprising:

a heating component configured to heat an image of toner that is attached to a recording medium by a forming component in order to fix the image to the recording medium;

a temperature sensor configured to detect a temperature of the heating component; and a vibration component configured to apply vibration to the temperature sensor in a waiting period in which image formation by the forming component is not executed and heating control by the heating component is executed.

15. The heat control system according to claim 14, wherein the heating component further comprises a heat generation member configured to generate heat, a heat transfer member configured to transfer the heat generated by the heat generation member to the recording medium while rotating, a pressing member configured to press the recording medium against the heat transfer member, and a moving mechanism configured to move one of at least the heat transfer member and the pressing member such that the heat transfer member and the pressing member approach or are separated from each other, and the vibration component rotates the heat transfer member while causing the moving mechanism to make the heat transfer member and the pressing member approach each other.

16. The heat control system according to claim 14, wherein the heating component further comprises a heat generation member configured to generate heat, and a controller configured to control the heat generation of the heat generation member such that a temperature detected by the temperature sensor approaches a controlled temperature in the waiting period, and the vibration component applies vibration to the temperature sensor if a detection state of the temperature sensor during execution of the control of the heat generation of the heat generation member by the controller is a predetermined abnormal state.

17. The heat control system according to claim 16, wherein the vibration component recognizes, as the abnormal state, a state where a change in the temperature detected by the temperature sensor in a state where the heat generation member generates heat is less than a predetermined change.

18. The heat control system according to claim 16, wherein the vibration component recognizes, as the abnormal state, a state where a change in the temperature detected by the temperature sensor in a state where the heat generation member does not generate heat is less than a predetermined change.

19. The heat control system according to claim 14, wherein the heating component is an induction heater.

* * * * *